United States Patent [19]

Erfort, Jr.

[11] Patent Number: 4,817,920

[45] Date of Patent: Apr. 4, 1989

[54] APPARATUS FOR CONTINUOUS HEAT TREATMENT OF METAL STRIP IN COIL FORM

[75] Inventor: Thomas J. Erfort, Jr., Pittsburgh, Pa.

[73] Assignee: Salem Furnace Co., Pittsburgh, Pa.

[21] Appl. No.: 79,699

[22] Filed: Jul. 30, 1987

Related U.S. Application Data

[63] Continuation of Ser. No. 835,549, Mar. 3, 1986, abandoned, which is a continuation of Ser. No. 673,890, Nov. 21, 1984, abandoned.

[51] Int. Cl.[4] ..... C21D 9/06

[52] U.S. Cl. ..... 266/252; 266/254

[58] Field of Search ..... 266/252, 111, 102, 103; 432/138, 198, 199

[56] References Cited

U.S. PATENT DOCUMENTS

| | | | |
|---|---|---|---|
| 2,613,070 | 10/1952 | Verwohlt | 263/2 |
| 3,063,878 | 11/1962 | Wilson | 148/13 |
| 3,084,081 | 4/1963 | Carpenter | 148/14 |
| 3,109,877 | 11/1963 | Wilson | 266/5 |
| 3,114,539 | 12/1963 | Wilson et al. | 263/40 |
| 3,846,190 | 11/1974 | Raabe et al. | 148/155 |
| 3,948,595 | 4/1976 | Raabe et al. | 432/260 |
| 4,406,618 | 9/1983 | Maeyama | 432/23 |

*Primary Examiner*—Christopher W. Brody

*Attorney, Agent, or Firm*—Webb, Burden, Ziesenheim & Webb

[57] ABSTRACT

Metal strip in coils is heat-treated by impinging jets of a temperature-controlled gaseous medium on the ends of the coils which are positioned with the coil axis horizontal. The medium is recirculated through heat exchangers. A rotating hearth furnace for such heat-treating has an annular hearth which carries coils in intermittent movement through successive stations in which the gaseous medium is directed on the coils.

4 Claims, 4 Drawing Sheets

APPARATUS FOR CONTINUOUS HEAT TREATMENT OF METAL STRIP IN COIL FORM

This application is a continuation of applicant's application Ser. No. 835,549, filed Mar. 3, 1986, now abandoned, which was a continuation of applicant's application Ser. No. 673,890, filed Nov. 21, 1984, now abandoned.

FIELD OF THE INVENTION

This invention relates to the heat-treating of metal strip in the form of coils. It is more particularly concerned with apparatus and process of continuously heat-treating a succession of such coils, of aluminum or of other metals.

BACKGROUND OF THE INVENTION

It is often desirable to heat-treat metal strip in coil form under controlled atmosphere conditions. Historically this was accomplished with steel strip by placing a coil on end on a stool, or a stack of coils on end, one on top of the other, by closing them with an open-bottom cover, usually called a bell, and heating the stool, coil or coils and bell in a furnace. The bell was sealed to the stool during that heating and the desired atmosphere maintained by introducing an appropriate gas into the bell under a pressure above that obtaining in the furnace. The coils were spaced from each other and the stool by separators in grating form so as to allow circulation of the atmosphere in the bell. Aluminum, however, is much softer than steel. Aluminum coils cannot be heated at temperatures approaching full anneal (about 735 degrees F.) standing on end or on gratings without incurring severe damage to the wraps. Historically, therefore, aluminum in coils has been heat-treated by placing each coil on its side on a car, pulling a string of such loaded cars into a long furnace and raising or lowering the furnace temperature to obtain the desired heat-treating cycle.

Both processes above-mentioned require that the furnace and its entire burden be raised to the desired heat-treating temperature, held at that temperature for the required length of time and cooled to the desired discharge temperature for each furnace charge. The cycle is then repeated for the next furnace charge. It is evident that such processes cannot be economical of heat.

PRIOR ART

Lee Wilson U.S. Pat. Nos. 3,063,878 of Nov. 13, 1962 and 3,114,539 of Dec. 17, 1963 disclose an improved practice and apparatus for coil annealing. The coils to be treated were first uncoiled and then rewound to leave space between adjoining wraps through which a heated gaseous medium could readily pass and transfer heat to the coil wraps by convection. Coils so wound were called "open" coils. That winding and re-winding had to be carried out with the coil axis vertical so that the spacing between wraps would be reasonably uniform and the coil had to be supported on end during its heat-treating. An open grating type of coil stool was employed. The coils could be treated as before under bells on a base or in a rotary hearth furnace as is disclosed in the '878 patent. In that way the time required for heat-treating and the amount of heat required was considerably reduced but the uncoiling and re-coiling operation, which had to be performed twice, once before and once after heat-treatment, and the necessity for handling the coils in upright position only were both undesirable and relatively costly.

Verwohlt U.S. Pat. No. 2,613,070 of Oct. 7, 1952 has to do with the heat-treating of metal strip in coil form in which a coil is loaded onto a horizontal mandrel and rotated thereon in a furnace. The coil and the portion of the mandrel within it is enclosed in a cover into which a protective atmosphere is introduced. The weight of the coil causes those wraps below the mandrel axis to separate, and that separation is augmented by the differential expansion of the outer coil wraps with respect to the inner wraps, so that heating of the coil wraps by convection is facilitated. While Verwohlt's invention would minimize damage to coil ends, it would require the entire furnace to be heated and cooled, and the loading and unloading of coils into and out of the furnace would be time-consuming.

It is evident that the procedures above outlined are not well adapted for coils of aluminum strip.

SUMMARY OF THE INVENTION

My invention to be disclosed in detail hereinafter comprises apparatus and process which do not require the unwinding and re-winding of coils and allows the coils to be treated with the coil axis, horizontal. I have found that heat transfer by conduction proceeds much faster from the ends of a coil along a wrap toward the middle than along a radius of a coil, from a wrap to the adjoining wrap. In my invention I introduce heat into a coil preferably from each end over the entire cross-section of the coil. This procedure is especially advantageous for coils of aluminum strip as the heat conductivity of aluminum is high compared to that of steel, but my invention is also advantageous for coils of metal other than aluminum. My invention also makes possible the heat-treating of metal strip in coil form in a continuous manner, in that coils are automatically introduced in succession into serially disposed treating stations by indexing means which cause each coil to remain for a predetermined period of time in its station and then move it into the next succeeding station. In the various stations, which are held at constant temperatures, the desired heating, soaking and cooling stages of the cycle are carried out. A circular rotating hearth furnace for heat-treating coils as above described is disclosed.

DESCRIPTION OF PREFERRED EMBODIMENT

Figure 1:
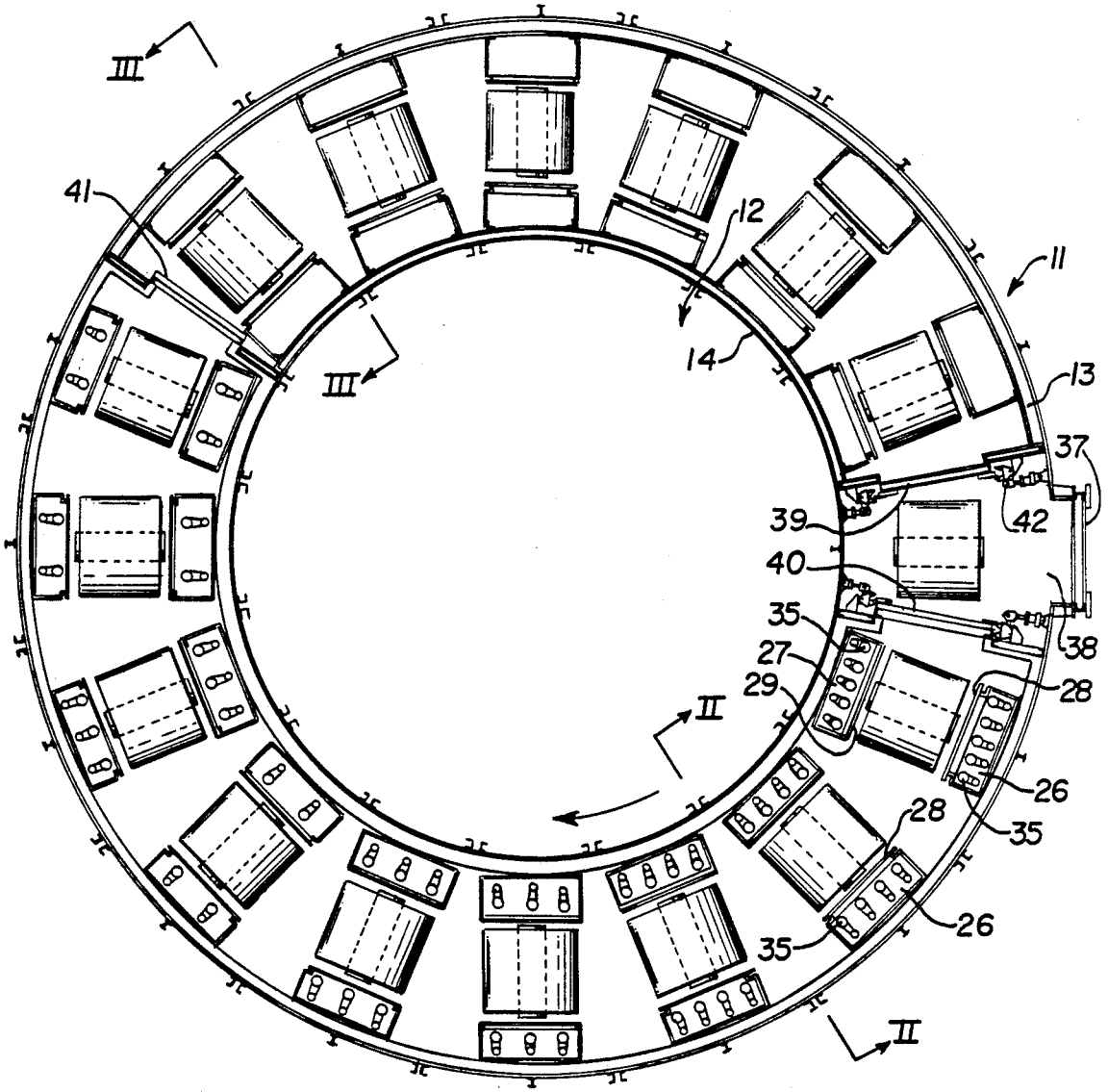
FIG. 1 is a horizontal section through my furnace on the plane I—I of FIG. 2.
Figure 2:
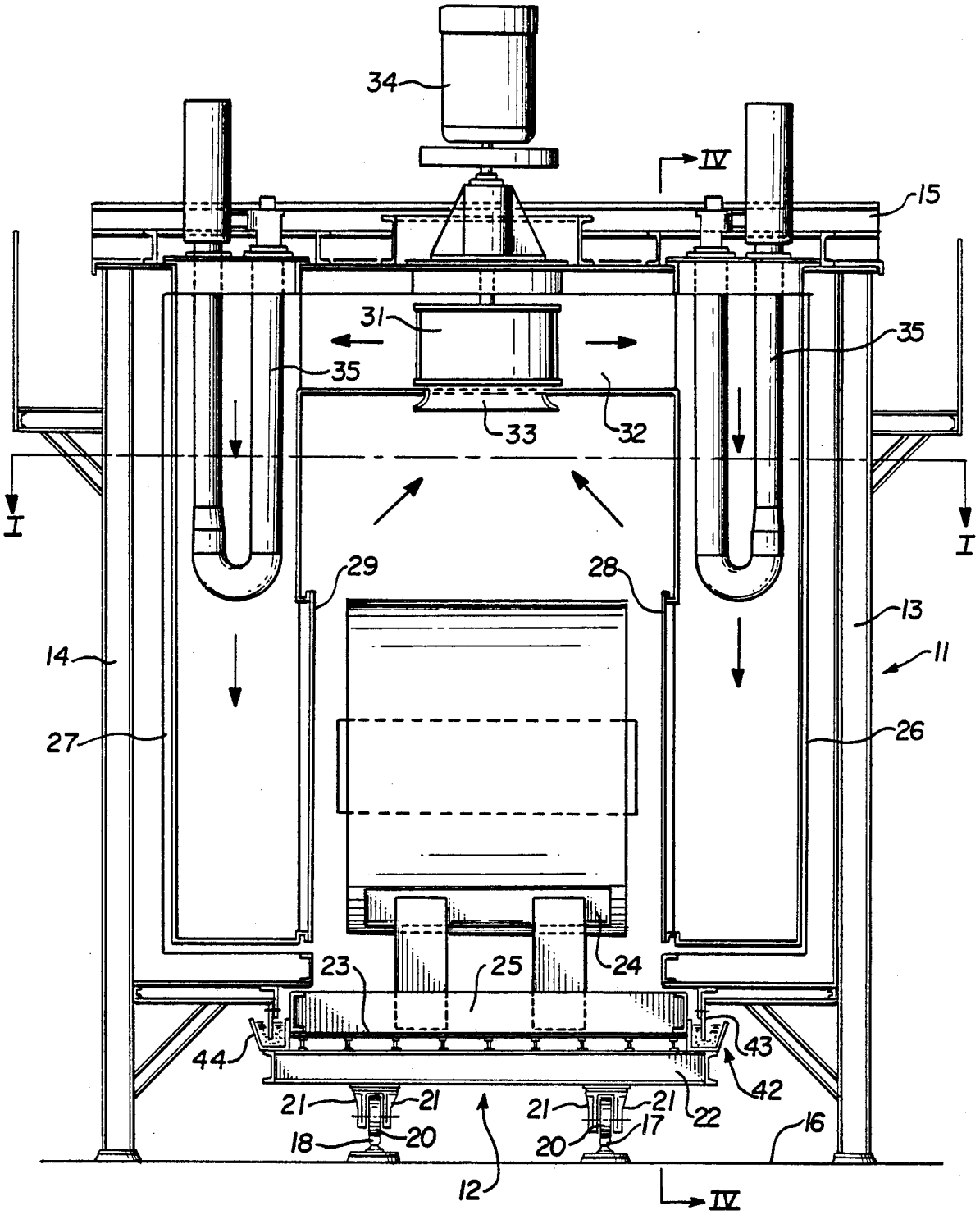
FIG. 2 is a vertical section through a portion of the furnace of FIG. 1 taken on the plane II—II of that figure.
Figure 3:
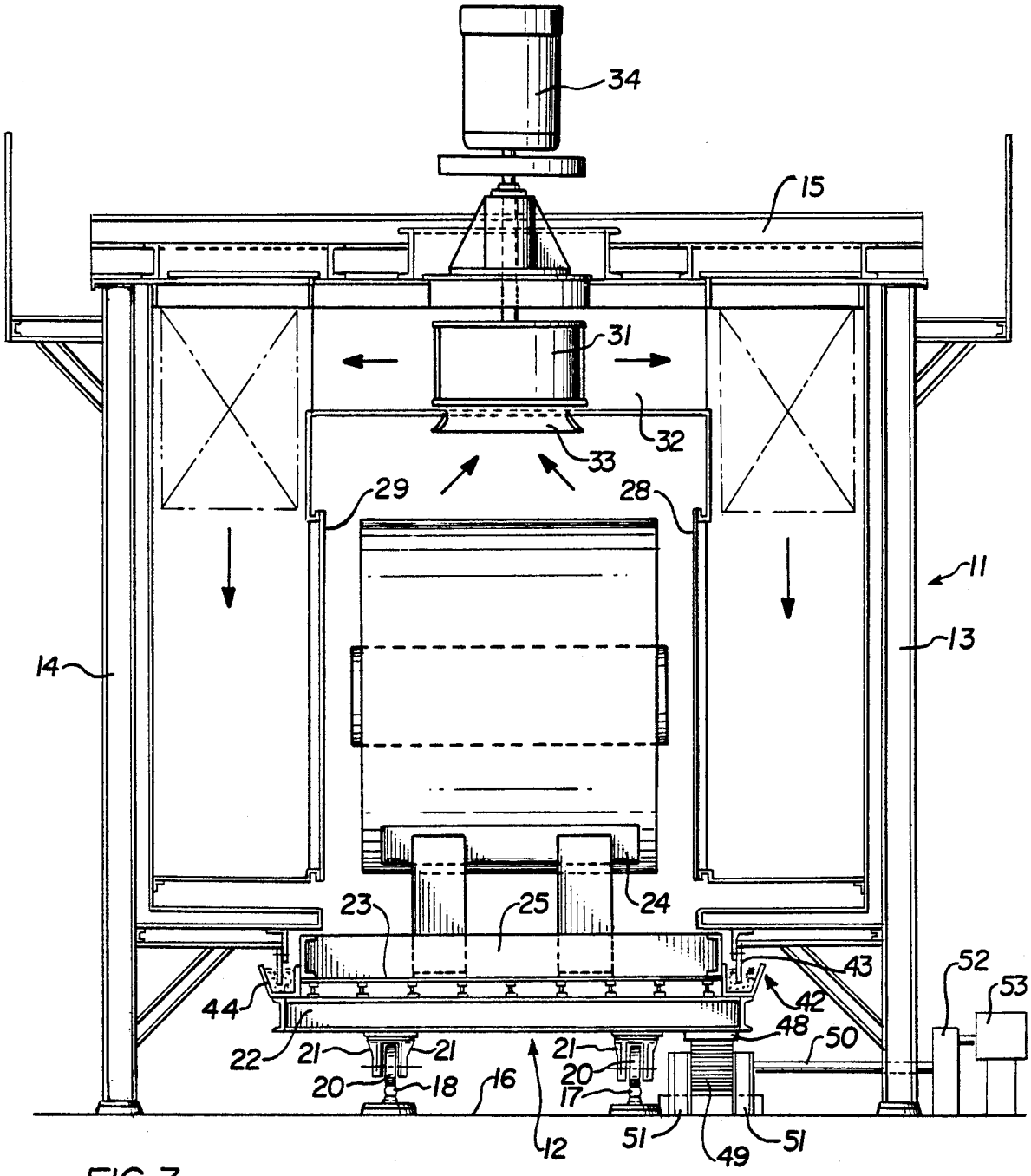
FIG. 3 is a vertical section through a portion of the furnace of FIG. 1 taken on the plane III—III of that figure.

From FIGS. 1 and 2 it will be seen that my furnace comprises a stationary annular shell 11 with a rotating hearth 12. Shell 11 has a cylindrical outside wall 13, a cylindrical inside wall 14 and a flat annular roof 15 extending between walls 13 and 14. The foundation 16 for walls 13 and 14 also supports a circular track comprising an outer rail 17 and an inner rail 18 disposed between the walls 13 and 14. Hearth 12 travels on the track comprising the two rails above-mentioned. Flanged wheels 20—20 on stub shafts journalled in brackets 21—21 roll on rails 17 and 18. Spaced brackets 21—21 are affixed in pairs ;to the lower flanges of cross beams 22 which are uniformly spaced from each other arcuately on radii of shell 11 and carry the annular floor 23 of hearth 12.

On annular floor 23 are positioned coil holders 24 uniformly spaced angularly therearound and formed to support a coil resting on its circumferential surface with the axis of the coil center on a radius of shell 11. In all sections normal to such radius the coil holder 24 has a concave-up coil engaging profile. I prefer to employ separate coil holders for each different diameter of coil treated; for example a 60-inch diameter coil would be supported on a coil holder 24 having a concave upper surface with a radius of 30 inches or slightly more. The weight of the coil holds it on such a coil holder without any fastening device.

Figure 4:
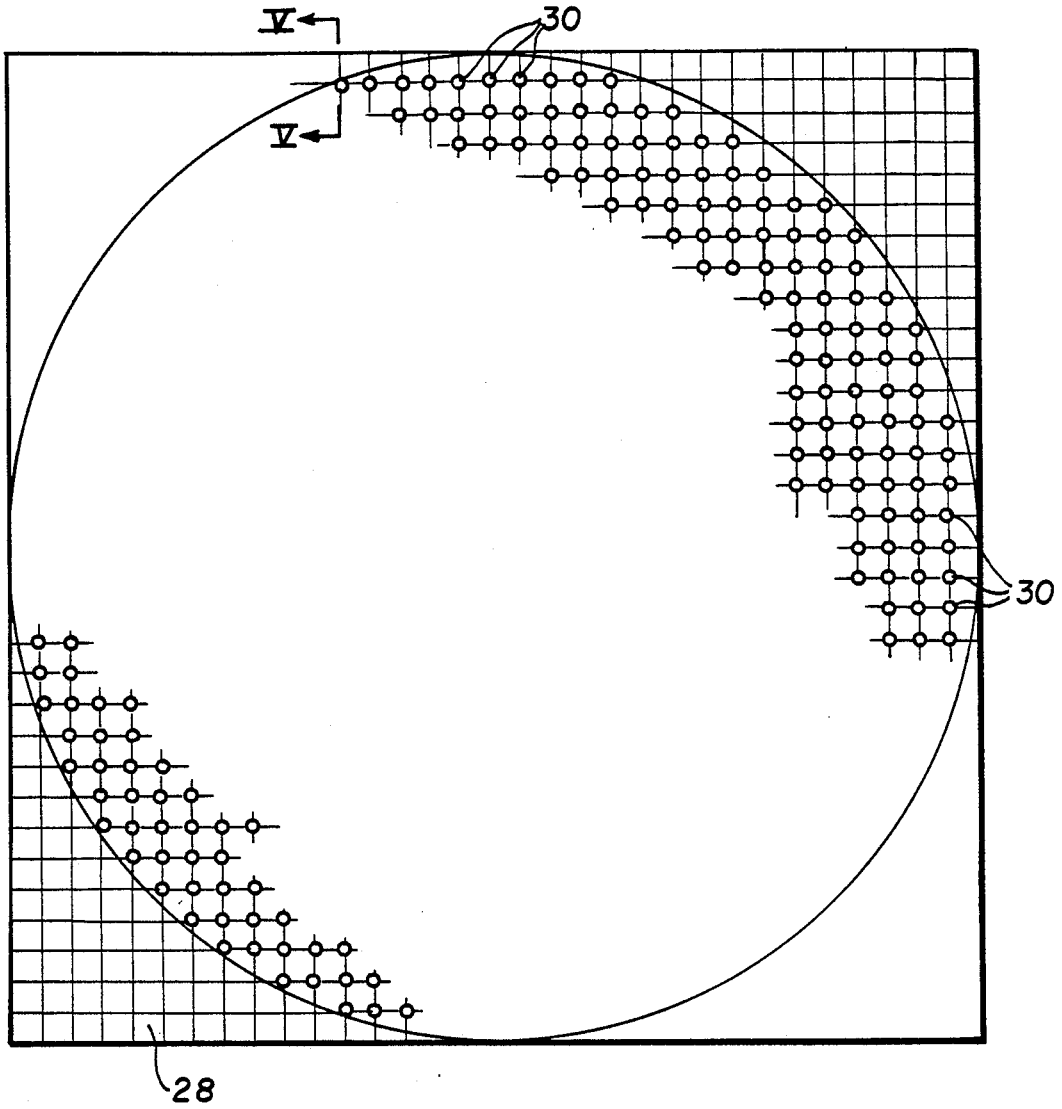
FIG. 4 is an enlarged partial vertical section through a portion of the furnace of FIG. 2 taken on the plane IV—IV of that figure.
Figure 5:
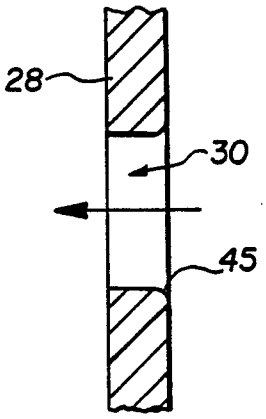
FIG. 5 is an enlarged detail of an aperture of FIG. 4 taken on the plane V—V of FIG. 4.

Spaced around the inner face of outside wall 13 are distribution chambers 26 and spaced around the face opposite those chambers 26 along inside wall 14 are like distribution chambers 27. Each chamber 26 is positioned opposite the outside end of a coil holder 24 when the hearth 12 is stationary and each chamber 27 is positioned opposite the inside end of that coil holder. As will be explained hereinafter there is one less pair of distribution chambers 26 and 27 than the aggregate number of coil holders 24. The distribution chambers are essentially oblong boxes having flat opposing faces 28 and 29 respectively parallel to the ends of a coil positioned between opposite chambers. Each opposing face 28 and 29 is formed with a pattern of holes 30 disposed over an area corresponding to the end face of a coil, as is shown in FIG. 4. The holes 30 have rounded edges 45 inside chambers 26 and 27 as is shown in FIG. 5.

Each distribution chamber 26 is connected at its upper end to a separate cross header 32 which is positioned against the lower surface of chamber roof 15. The other end of cross header 32 is connected to opposite distribution chamber 27 at its upper end. At the center of each cross header 32 is an intake opening 33 opening into the furnace chamber. Within each cross header 32 at opening 33 is positioned a suction fan or blower 31 driven by a motor 34 mounted on the roof 15 outside the furnace chamber. Within most of the distribution chambers 26 and 27 are located heat exchangers 35, the ends of which project through the roof 15 so as to be connected to heating sources or cooling sources, not shown.

A loading and unloading door 37 is provided in outer wall 13 of my furnace. A loading and unloading station 38 is defined at that doorway by doors 39 and 40 within the furnace chamber positioned crosswise thereof one on each side of door 37. If the heating cycle for which my furnace is employed includes a heating stage and a cooling stage I provide a door 41 similar to doors 39 and 40 at another location in my furnace chamber as will be made clear hereinafter. Doors 37, 39, 40 and 41 are positive seal doors that are gas-tight when closed and which open and close by sliding vertically. Gas-tight seals 42 are also fitted between the rotary hearth 12 and the furnace shell 11. Those seals are of conventional type comprising a vertical rib 43 affixed to the lower edge of shell 11 moveable in trough 44 affixed to the hearth 12, the trough being filled with sand or other granular material, or water or other fluids.

The hearth 12 is rotated on its circular rails 17 and 18 by a circular rack 48 affixed to the bottom of cross beams 22 which meshes with a pinion 49. The latter element is affixed to a horizontal shaft 50 journalled in bearing blocks 51—51 on foundation 16 which shaft is connected to a reducing gear box 52. The gear box in turn is driven by a motor 53.

It will be evident from the foregoing description and the drawings that the specific furnace described herein comprises a loading and unloading station 38 and fifteen heat treating stations spaced uniformly around the remainder of its 360 degree circumference. Generally speaking, the stations between doors 40 and 41 in the direction of hearth rotation shown in FIG. 1 are heating stations and those between doors 41 and 39 are cooling stations. The rotary hearth 12 carries 16 coil holders uniformly spaced, each holding one coil. Each station is provided with an outer wall distribution chamber 26 and an inner wall distribution chamber 27, opposite each other and opposite the ends of any coil positioned between them. The number of heat-treating stations depends primarily on the size of the coils and the nature of the heat-treating cycle. The atmosphere in all heating stations, between doors 40 and 41, is the same. The atmosphere in all cooling stations, between doors 40 and 39, is the same but not necessarily the same as the atmosphere in the heating stations.

Hearth 12 is caused to rotate intermittently. A coil loaded in loading station 38 at ambient atmosphere is held there with doors 37, 39 and 40 closed until the atmosphere in that station is modified to correspond to that in the heating stations. Then door 40 together with doors 39 and 41 are raised and hearth 12 is rotated to bring the coil into the first heating station. Door 40 together with doors 39 and 41 are lowered and hearth 12 is stopped and remains stationary for a pre-determined period of time. The atmosphere in the heating station is circulated by the suction fan 31 as has been described herein. Heat exchangers 35 heat the atmosphere and the heated gaseous atmosphere is projected against the ends of the coil through the apertures 30 in faces 28 and 29 of distribution chambers 26 and 27 respectively. At the end of the pre-determined period of time the hearth is caused again to rotate sufficiently to bring the coil into the next adjoining heating station. the coil is brought up to the desired temperature in that way through several heating stations depending upon the pre-determined time period, which is maintained constant. The heat input from the heat exchangers in each station is adjusted to bring the coil to the desired temperature at the desired time. The coil is then transferred to the soaking section of the furnace, in which the heat inputs are adjusted to render the coil temperature uniform at the desired level. When that uniformity has been achieved in the last soaking station door 41 together with doors 39 and 40 are raised and the hearth carries the coil into the first of the cooling stations. Here heat exchangers are used to reduce the temperature of the atmosphere, which again is circulated and projected against the coil ends as jets in the manner previously described.

The heat exchangers may be heated by combustion or electrically. In the cooling station, or some of them, ambient air or water circulation through the heat exchangers may provide sufficient cooling. In all stations the atmosphere, heated or cooled, is circulated as has been mentioned and is projected in the form of jets against the ends of the coil through the apertures 30 in faces 28 and 29 of distribution chambers 26 and 27 respectively. I have found that jets having bulk velocities in the range of about 50 to about 300 feet per second are satisfactory for annealing aluminum strip in coil form. The size and number of apertures 30 depends on the pressure developed in the distribution chamber, the arrangement of apertures, which should correspond to the coil cross-section as is shown in FIG. 4, and the spacing between faces 28 and 29 and the coil ends.

In the foregoing specification I have described presently preferred embodiments of my invention; however, it will be understood that my invention may be otherwise embodied with the scope of the following claims.

I claim:

1. In an enclosed annular furnace chamber for heating coils of metal strip having a rotatable annular hearth and stationary sidewalls and roof the improvement comprising means affixed to said hearth for supporting said coils on their outermost wraps with their axes in radial directions, a plurality of separate distribution means within said chamber including perforated face portions having a circular shape substantially corresponding to a coil end for simultaneously projecting a temperature-modifying gaseous medium against both ends of said coils and through the coil eyes and around their outer surfaces, said distributing means being spaced from said coil ends and positioned against said inner and outer sidewalls and adjacent said roof respectively to form spaced-apart stations around the furnace chamber, means for cyclically indexing the rotary hearth a distance equal to the spacing between adjacent stations and for holding at said position a predetermined period of time prior to repeating a next indexing cycle, whereby, each of the stations treat a coil as said coil is indexed around said furnace chamber, means positioned in the upper portion in each said station for withdrawing said gaseous medium from around the coil in that station and recirculating the same medium through said distributing means at that station, whereby the temperatures of said coils are modified by heat conduction between both ends of said coils and their centers.

2. The apparatus of claim 1 in which at least some of said separate distribution means include heat exchanger means.

3. The apparatus of claim 1 in which said separate distribution means at each station are connected at their upper ends with medium-circulating means for drawing off said gaseous medium from within said chamber and returning it to said distribution means.

4. The apparatus of claim 1 including a loading and discharging station having a positive sealing door in its outside wall and positive sealing doors between it and its adjoining stations.

* * * * *